United States Patent [19]

Enneking et al.

[11] 4,339,091

[45] Jul. 13, 1982

[54] DEVICE FOR DEPOSITING CABLE INTO A RECEIVING CONTAINER

[75] Inventors: Heinrich Enneking, Karlsruhe; Günter Schubert, Malsch; Ludwig Hauger, Karlsruhe; Rolf Mladek, Bruchsal-Untergrombach, all of Fed. Rep. of Germany

[73] Assignee: Industrie-Werke Karlsruhe Augsburg Aktiengesellschaft, Fed. Rep. of Germany

[21] Appl. No.: 256,008

[22] Filed: Apr. 21, 1981

Related U.S. Application Data

[62] Division of Ser. No. 953,120, Oct. 20, 1978, Pat. No. 4,304,366.

[30] Foreign Application Priority Data

Oct. 25, 1977 [DE] Fed. Rep. of Germany ..... 2747706

[51] Int. Cl.[3] ..... B65H 54/76; B65H 51/20

[52] U.S. Cl. ..... 242/47; 242/82; 242/47.12; 242/47.13

[58] Field of Search ..... 242/47, 47.01, 82, 83; 66/132 R; 28/289; 139/452 R

[56] References Cited

U.S. PATENT DOCUMENTS

| | | | |
|---|---|---|---|
| 2,929,493 | 3/1960 | Henning | 242/47.1 |
| 3,759,300 | 9/1973 | Pfarrwaller | 242/47.01 X |
| 3,776,480 | 12/1973 | Lawson | 242/47.12 X |
| 3,791,598 | 2/1974 | Vischiani et al. | 242/47.12 |
| 3,921,925 | 11/1975 | Sarfati et al. | 242/47.12 |
| 3,955,769 | 5/1976 | Kajiura et al. | 242/47.01 |
| 3,971,522 | 7/1976 | Pfarrwaller | 242/47.01 |
| 4,028,911 | 6/1977 | Fecker | 242/47.12 X |
| 4,039,155 | 8/1977 | Jacobsson | 242/47.12 |

FOREIGN PATENT DOCUMENTS

| | | | |
|---|---|---|---|
| 101457 | 2/1899 | Fed. Rep. of Germany | 242/47.12 |

*Primary Examiner*—Stanley N. Gilreath
*Attorney, Agent, or Firm*—McGlew and Tuttle

[57] ABSTRACT

A device for depositing a cable into a receiving container or can, comprises, a rotary distributor including a rotatable cable distributing tube extending obliquely downwardly in the distributor which has an inlet into which the cable is directed adjacent the center of rotation and a cable discharge adjacent its bottom disposed at a location spaced radially outwardly of the cable inlet. The cable receiver has a side with a curved periphery which is located adjacent the tube in a position to receive cable which issues out of the outlet of the tube and engages around the surface of the receiver. The receiver is mounted for rotation relative to the distributor so that there is a driving rotation of one relative to the other to effect the deposit of the coils of the cable around the cable receiver. The receiver can is disposed below the receiver to push the coils of cable as they are deposited on the receiver downwardly along the surface of the receiver and then off of the surface into the can.

8 Claims, 11 Drawing Figures

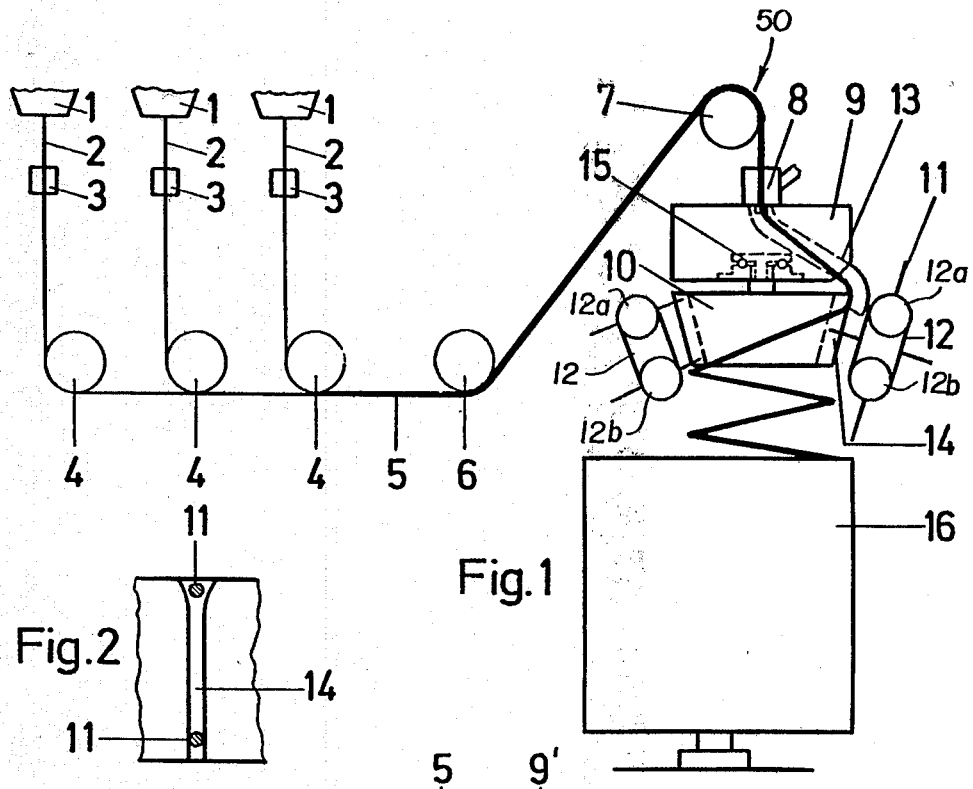
Fig.1
Fig.2
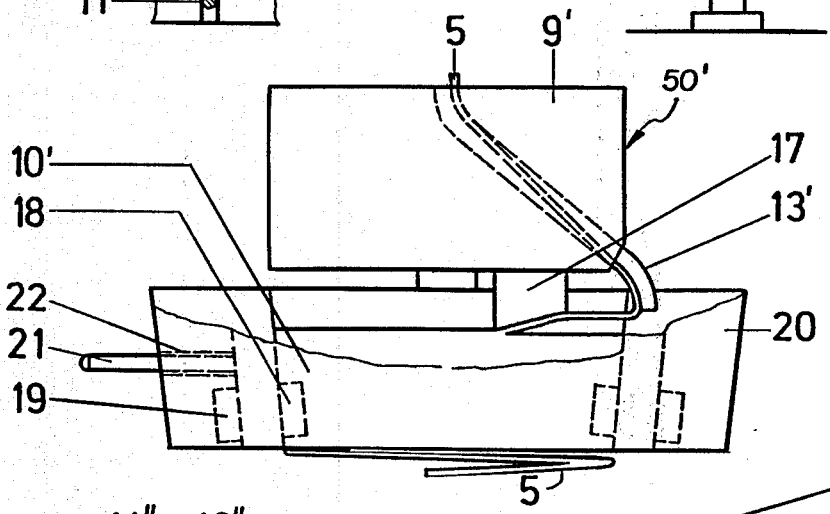
Fig.3
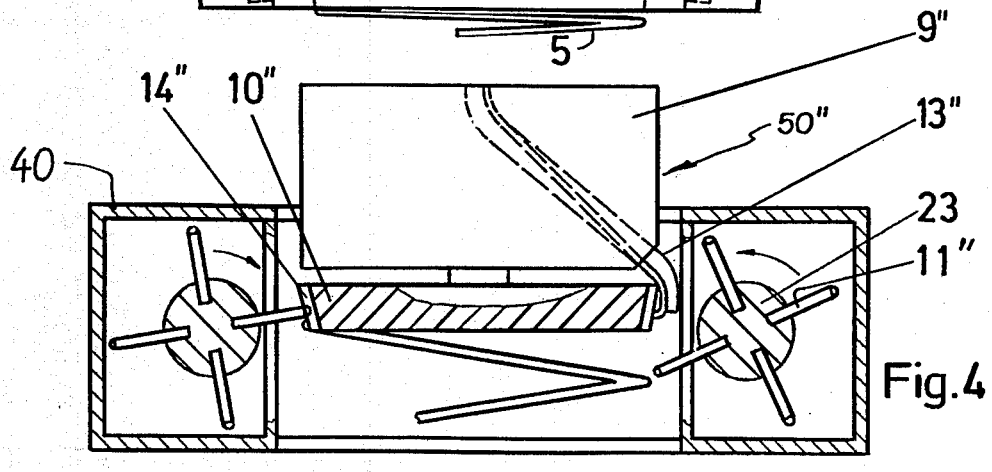
Fig.4

DEVICE FOR DEPOSITING CABLE INTO A RECEIVING CONTAINER

This is a division of application Ser. No. 953,120 filed Oct. 20, 1978, now U.S. Pat. No. 4,304,366.

FIELD AND BACKGROUND OF THE INVENTION

This invention relates to cable feeding devices in general and, in particular, to a new and useful device for depositing a cable having a plurality of filaments, in particular, a cable of chemical fibers in a can or container, with the cable being wound from the outside on a receiving body by means of a sorting arm or distributor, with the spirals thus produced being detachable from the receiving body by means of a transport device, and with the receiving body, which is in itself rotationally movable in the rotating distributor, being prevented from rotating, contactlessly or respectively with the use of force- or form-locking means.

DESCRIPTION OF THE PRIOR ART

In the production of staple fibers, the filaments spun from a nozzle are, in a manner known per se, joined to cables in a first step and then deposited in cans or containers. In known can depositions, which operate at speeds up to 1500 m/min., the cables are deposited directly into the cans by means of toothed rollers.

At higher operating speeds, which are desirable from the viewpoint of reducing the staple fiber manufacturing costs, the impingement energy of the cable is so great, however, that the cable spirals already deposited in the can would be churned. Owing to this, it is practically impossible to draw the cable properly from the can during the next following operation. To counteract such undesirable phenomena or to avoid them, it is customary to reduce the deposition speed by either upsetting the cable or depositing it in wave shapes. Particularly at great cable thicknesses, however, this method has proven to be impractical.

It is further known to reduce the deposition speed by forming a helical cable column from the extended cable in the air which then deposits in the can by itself. To produce such a column, either curved pipes or turbo-distributors are used. It has proven to be rather difficult, however, to deposit such a cable column formed in the air in the can, without rotation, because even at optimal design of such rotary distributors, the cable column is found, in practice, to invariably be more or less unstable. Such instability necessarily leads to overwinding and slipping of the already deposited cable spirals and finally to disarray. This disarray frequently is the cause of interruptions in further processing.

To remedy these and similar situations, it is customary to decelerate the cable column in the direction of rotation by depositing the cable in a pipe or in the interior of a cage formed by rods. However, because of the high speed of rotation of the distributor, it is practically impossible to remove the spirals, thus decelerated downwardly, quickly enough by gravity alone. To provide some remedy to this problem, it is known to transport the spirals formed on the inner wall of the pipe or cage downwardly by means of a veil of air or to use a cage formed by conveyor belts, in order to lay the spirals of the cable directly on the cage.

Even if, with the above described measures, the cable spirals can be prevented from the undesired rotation while still transporting them reliably, such a procedure has the general disadvantage that it requires a high centrifugal force, for one thing, to draw the cable from the feed rollers, and secondly, to cause it to make contact on the inner wall of the pipe or cage.

Measures and procedures such as those described above are therefore tied to minimum speeds, which depend on the type of fiber used, the cable thickness, and the spin finish, among other things. Moreover, they require a relatively expensive cable feed, in order to have to apply little tension, to the extent possible, for drawing the cable into the rotary distributor.

Another procedure which has become known aims to wind the cable on a stationary body by means of a rotating distributor and then to detach the sprials thus produced from it. This method has the advantage that, due to the overfeed of the distributor relative to the godets, any desired tension can be set. This method can thus be used for all speeds and cable thicknesses. In addition, the deceleration of the cable spirals in the direction of rotation is ensured, particularly since the spirals, due to their traction, exert a pressure directed radially inwardly on the receiving body and thereby supply the necessary frictional force themselves. At high speeds, however, the tension required for drawing the cable off of the godets and for overcoming the centrifugal force during winding on the receiving body is very great. Consequently, an equally great pressure is imparted to the receiving body. However, as this pressure is preserved after the depositing, it is extremely difficult to again detach the cable spirals from the receiving body and to transport them into the can.

It is also known to design the receiving body in a conical form and to detach the spirals from it by vibration. Such a procedure can be employed with some prospect of success only at relatively low winding tensions. As such low winding tensions are insufficient to draw the cable off of the godets at high speeds, this mode of pushing off is unsuitable in practice. A suitable method of detachment of the spirals from the receiving body and the manner in which the stationary body is to be mounted must therefore be regarded as still unsolved. Even if its support should be successful, in whatever manner employed, it still remains problematical inasmuch as access to the receiving body from above is hindered by the rotating distributor, and from below, by the falling cable column.

In German Pat. No. 929,123, although for a different area of application in textiles, a solution for the mounting of a detaching body and the detaching of the filament spirals from this body has been proposed.

Here, the receiving body is rotatably mounted in the rotary distributor and it is prevented from rotating from the outside. The wound helical spirals are converted to flat spirals and are then spooled on a spool. Detachment of the spirals from the receiving body occurs by means of conveyor belts which are arranged in slots in the receiving body and which push the spirals across the coil former. The conveyor belts are driven from within by the rotary distributor through a worm drive.

SUMMARY OF THE INVENTION

The practical application according to the invention further to be discussed here differs very essentially from the proposal according to German Pat. No. 929,123 by the fact alone that not filaments, but relatively thick cables are received, and that the cable spirals are not to be spooled but deposited in cans as helical spirals at very high speeds. Although the solution already proposed according to German Pat. No. 929,123 is quite advantageous, it certainly cannot be transferred to the practical application given here, as the conveyor belts proposed as the transport means are by no means sufficient to detach the thick cable spirals from the conveyor belts after they have been wound on them with great tractive force.

A major defect also exists in the solution proposed according to German Pat. No. 929,123 especially in that the transport means are driven from within, so that besides the bearing friction moment, the drive moment of the transport means is also transmitted to the receiving body and must be absorbed by force- or form-locking means acting from the outside.

Building on the solution proposed in German Pat. No. 929,123, the present invention has set itself to the task of showing at least one practical means of a solution to bring about the detachment of the cable from the receiving body in a simple and expedient manner and of keeping the torque exerted on the receiving body, which is to be absorbed from the outside, as low as possible.

This problem is essentially solved by constructing a transport device with at least one pusher firmly connected with a rotary distributor whose receiving body cooperating with it comprises means by which it, together with matching further means, essentially arranged in a stationary outer ring, is prevented from participating in the rotational movement originating from the rotary distributor. In a development of the idea of the invention, these means, as well as the matching further means, comprise permanent magnets which are known per se.

Another solution which is as simple as it is low in cost, comprises a pusher having a pusher surface which extends over almost the entire circumference and has different slopes or which may be stepped or wavy.

Accordingly, an object of the invention is to provide a device for depositing cable into a receiving can or container which includes means for feeding the formed cable into a rotary distributor which includes a tube through which the cable passes which has a central inlet and a lower discharge which moves relative to the surface of an annular receiver which is mounted for relative driving motion relative to the distributor and which further includes a pusher mechanism for engaging the successive coils as they are formed around a receiver pushing them downwardly in a direction to deposit the coils successively into a receiving can or container.

A further object of the invention is to provide a cable depositing device which includes a drive mechanism associated with a receiver around which coils are wound and which is effective to push the coils in succession downwardly off of the receiver into a receiving can or container.

Another object of the invention is to provide a method of feeding cable, after it is formed, into a receiving container which comprises, directing successive coils of the cable around an annular receiver, which is oriented above a receiving container and pushing the coils as they are formed downwardly along the receiver surface and into the container.

A further object of the present invention is to provide a device for depositing cable into a receiving container which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 1 is a schematic representation of a cable forming and cable depositing device, constructed in accordance with the invention;

FIG. 2 is a partial side elevational view, partly in section, indicating the receiver shown in FIG. 1;

FIG. 3 is a view similar to FIG. 1 of another embodiment of the device;

FIG. 4 is a view similar to FIG. 1 of a further embodiment of the device;

DESCRIPTION OF THE PREFERRED EMBODIMENTS

Figure 5:
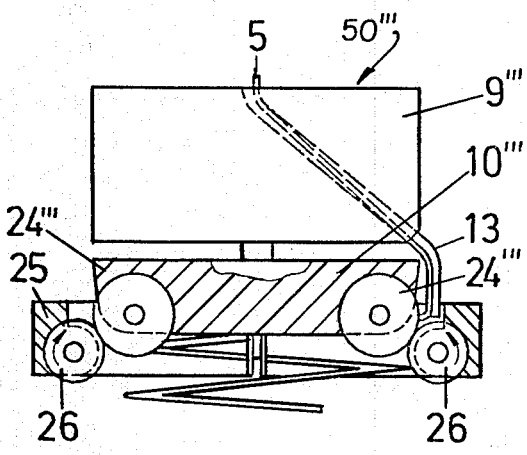
FIGS. 5, 6, 7 and 8 are views similar to FIG. 1 of still further embodiments of the device of the invention.

Referring to the drawings in particular, the invention embodied therein in FIG. 1, comprises a cable forming and cable depositing device, generally designated 50, in which a cable 5, after it is formed of many chemical fibers 2, from the different spinning chimneys 1, which are guided through spin finish means 3 and then into the cable depositing device portion of the machine.

In FIG. 1, the filaments 2 emerging from the spinning chimneys 1 are passed over spin finish means 3 and godets 4 and are lastly joined to form a cable 5. Cable 5 is then passed over additional godets 6 and 7 of a can depositing device. More specifically, the device consists of an injector nozzle 8, a rotary distributor 9, a receiving body 10 and several endless belts or chains 12 having pins distributed at spaced locations along its circumference. The chains are guided over guide sprockets **12*a* and 12*b*. The injector nozzle 8 projects contactlessly into the rotary distributor 9 and blows the cable at the beginning of the deposition process through a rotating tube 13 of the rotary distributor 9. Tube 13 is rotated with the distributor 9 to deposit the cable 5 on the stationary receiving body 10**.

In FIG. 1, the detaching of the individual spirals of cable 5 from the receiving body 10 occurs, for example, by means of pins 11, which are fastened on the moving chains 12 and engage in longitudinal slots 14 (FIG. 2) of the receiving body 10. The number of chains 12 and their arrangement around the circumference of the receiving body 10 can be chosen and designed as desired. The drive of chains 12 is combined positively, in a manner which has not been shown, with the drive of the rotary distributor 9, namely, so that a pin 11 penetrates into a slot 14 of the receiving body 10, only after tube 13 of the rotary distributor 9 has passed the respective slot 14.

Receiving body 10 is rotatably mounted in the rotary distributor 9. The bearing 15 required for this purpose may be arranged, according to FIG. 1, in the rotary distributor 9, or alternatively, it may be arranged in a reversal of this principle, namely, in the receiving body 10. Due to the bearing friction, the receiving body 10 has a tendency to rotate. However, it is prevented from doing so by the pins 11 of the chains 12 meshing with the slots 14 distributed at spaced locations around the circumference of the receiving body 10. In order to achieve an exact conduction of the cable 5 by means of pins 11, and in order not to interfere with the penetration of pins 11 into slots 14, the slots taper radially inwardly and downwardly (FIG. 2). The exact conduction of pins 11 is always effected by means of pins 11 in engagement in the lower region. In this case, however, the receiving body 10 consists preferably of circularly arranged rods or ribs widening downwardly, rather than of a slotted tube. The pins matching them then engage in the rod gaps or the like, tapering downwardly, an analogy to the slots 14.

Cable 5, which is stripped off of the receiving body 10 by pins 11, is deposited into the rotating can or container 16. The diameter of the spirals of cable 5 is about the same or greater than the radius of container 16. This results in the advantage that an additional changover can be dispensed with. It is possible, in addition, to dispense with a drive of container 16 by suspending the entire depositing device for pendulum motion and letting it circle over the can.

In the depositing device 50' according to FIG. 3, the cable 5 is deposited by the rotating tube 13' onto a receiving body 10' and is pushed off of the latter with the aid of a pusher 17. Pusher 17 is firmly connected with the rotary distributor 9', namely, in the direction of rotation, behind a depositing tube 13'. Due to its inclined pushing surface, pusher 17 pushes the deposited spiral downward and thus makes room for the next spiral.

In order to prevent the receiving body 10', mounted in the rotary distributor 9', from rotating, its shell is provided with several magnets 18. Magnets 19, opposite to magnets 18, are correspondingly formed and arranged in the stationary outer ring 20. Preferably, at the end of the push-off region, the receiving body 10' is offset slightly inwardly, so that the pushed-off spirals will fall without contact over the lower portion of the receiving body 10' required for the magnets 18 and 19. Pusher 17 may vary in width and may also have different slopes. It may even extend over the entire periphery of the receiving body 10 and have a constant or a variable slope. In addition, the push-off surface may be stepped or wavy. Naturally, several pushers 17 may also be distributed over the circumference of the receiving body 10, owing to which cable 5 can then be pushed off step-by-step.

At the beginning of the deposition process, the starting end of cable 5, blown in by means of the injector nozzle 8 of the FIG. 1 and FIG. 3 embodiments, must be retained briefly or clamped, to make it possible for spirals to form on the receiving body 10'. This takes place, for example, by means of pins 21, which engage in several bores 22 distributed over the circumference of an outer ring portion 20 and are moved at the start of the laying far enough inwardly for them to make contact with the receiving body 10'. The starting end of cable 5 deposits on the crown or rim formed by the pins 21. The resulting friction is sufficient to ensure application against the receiving body 10'. At the same time, the pins 21 ensure that the receiving body 10 is clamped during the mooring process and is not, for instance, due to a start-up jerk, set into rotation as the magnetic force is overcome.

As soon as cable 5 is moored, pins 21 are moved outward. Retraction and extension of these pins occurs either automatically or manually by means of a linkage, which has not been shown.

The depositing device 50'', according to FIG. 4, corresponds in principle to that according to FIG. 1. However, the pins 11'' serving to push off the spirals of cable 5 are fastened to revolving discs 23, rather than to revolving chains.

Other parts of FIG. 4 having similar numbers as in FIG. 3 but with double primes, denote similar parts as those in FIG. 3. Discs 23 are mounted for rotation on a support member 40. They are driven by any known drives.

Figure 9:
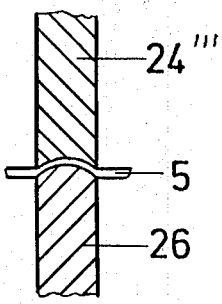
FIG. 9 is a partial sectional view through the driving and counter discs shown in FIG. 5.
Figure 10:
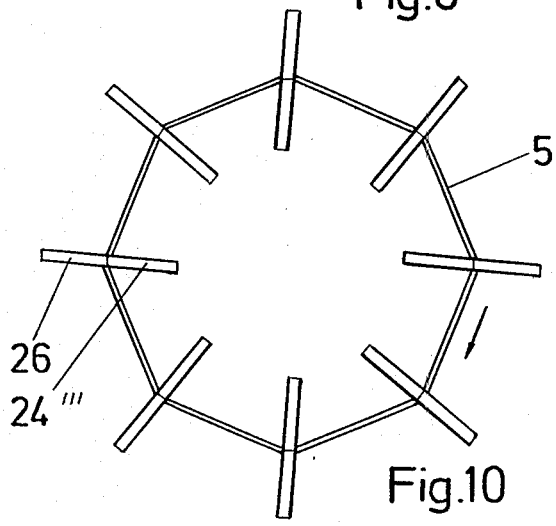
FIG. 10 is a schematic bottom plan view of the device shown in FIG. 5 indicating the driving connection between the cable pusher elements.

In the depositing device 50''' according to FIG. 5, discs 24''' are rotatably mounted in the receiving body 10'''. For this purpose, any desired number of such discs can be distributed over the periphery. In an annular body 25 disposed around the receiving body 10''', matching counter-discs 26 are arranged. These counter-discs 26 are drivable, and they are pressed against the discs 24'''. Cable 5 is deposited on the discs 24''' as a kind of polygon by means of the depositing tube 13, and immediately after deposition, the cable 5 is transported downwardly by cooperative action of the discs 24''' and 26. The spirals of cable 5 pass between discs 24''' and 26, so that, during operation, the drive of the discs 24''' occurs across the spirals of cable 5. To compensate thickness fluctuations in cable 5, the discs 26 may, for example, be mounted elastically. In addition, discs 24''' and 26 may be formed so that they interengage formlockingly and, in that way, prevent the receiving body 10''' from rotating, such as shown in FIG. 9. Alternatively, if necessary, discs 24''' and 26 may be readily arranged obliquely to the normal passing through the center of the receiving body 10''', for instance, so that they absorb the torque of the receiving body created by the bearing friction, as shown in FIG. 10.

In the depositing device described above and illustrated in FIG. 5, the winding tensions may be as high as desired. Also, it is by no means necessary in this proposed solution to arrange or provide counter-discs 26 opposite all of the discs 24'''. It may suffice to associate counter-discs 26 with only some of the discs 24''' and it is even possible to dispense with the counter-discs 26 altogether. When cable 5 is placed on the discs 24''' below the point of rotation of these discs, a moment is exerted on the discs due to the traction of cable 5, whereby, they are automatically set in rotation.

Figure 6:
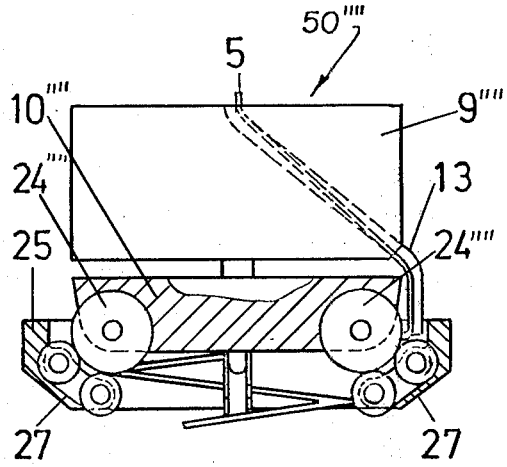

The depositing device 50'''', according to FIG. 6, corresponds in principle to that according to FIG. 5. In the variant solution according to FIG. 6, however, the counter-discs are replaced by revolving belts or bands 27 which act with discs 24'''' mounted on body 10''''. As these are elastic in themselves, a special elastic suspension can naturally be dispensed with.

Figure 7:
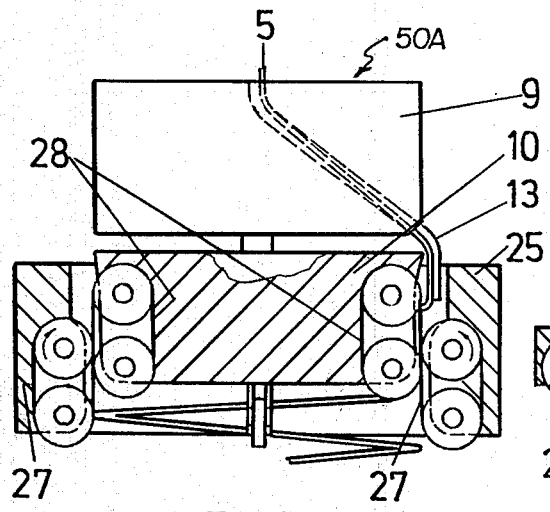
Figure 8:
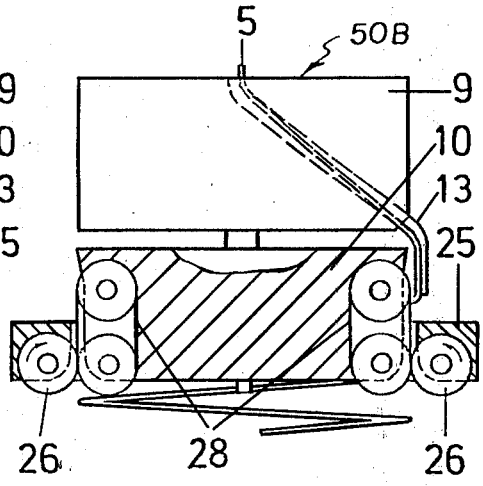

The depositing devices 50A and 50B, according to FIGS. 7 and 8 are further variations of the proposed solution specifically described and represented in FIG. 5. In the device according to FIG. 7, belts or bands 27 and 28 are inserted in both the annular outer body 25 and in the receiving body 10 whereas, in the device according to FIG. 8, belts or bands 28 are inserted in the receiving body 10 while discs 26 are arranged in the annular outer body 25.

The depositing devices according to FIGS. 7 and 8 have the additional advantage that the spirals of cable 5 are not subsequently reduced in diameter, as is found to be necessary in the devices according to FIGS. 5 and 6 for reasons of space.

Figure 11:
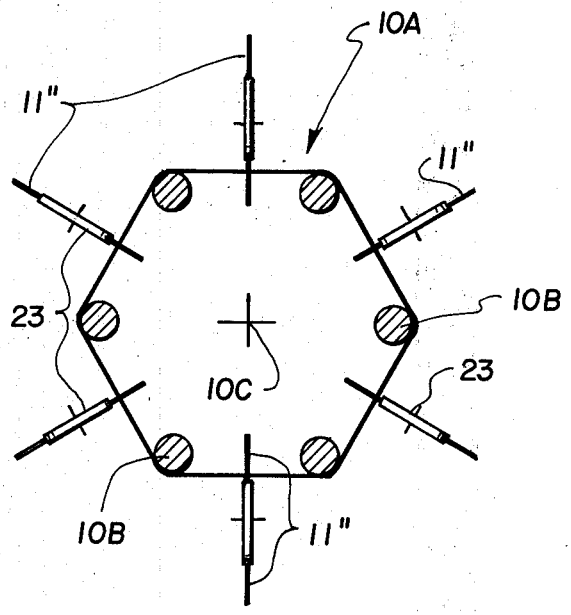
FIG. 11 is a partial top plan view of another embodiment of the invention.

FIG. 11 shows a form of the receiver which may use discs 23 with pusher pins 11'', for example, as the pusher means. The receiver 10A is formed of a plurality of spaced rods 10B which are spaced about a central axis 10C. The space between adjacent rods forms the guide slots or grooves for pins 11''.

While specific embodiments of the invention have been shown and described in detail to illustrate the application of the principles of the invention, it will be understood that the invention may be embodied otherwise without departing from such principles.

What is claimed is:

1. A chemical-fiber cable depositing device comprising:

a rotatable distributor including a rotatable cable distributing tube extending obliquely downwardly along the distributor and having a top end with a cable inlet disposed adjacent the center of rotation of said distributor tube and having a bottom end with a cable discharge disposed at a location spaced radially outwardly of said cable inlet;

a rotatable cable receiver located adjacent said distributor tube in a position to receive cable directly therefrom and having a plurality of guide slots therein, whereby the cable is wound around said receiver;

drive means to effect driving rotation of one of said distributor and said receiver relative to the other and to effect a deposit of coils of cable from the relative rotation and feeding of cable out of said outlet onto said receiver;

a receiving container disposed below said receiver in a position to receive the cable which is wound around said receiver;

and pusher means adjacent said receiver engageable with the cable as it is wound around said receiver and effective to push the cable downwardly along said receiver and off of said receiver into said container;

said pusher means comprising an outer support member disposed radially outwardly of said receiver, and a plurality of outer rotary members rotatable mounted to said support member each having at least one pusher pin connected thereto and movable in a direction of deposit of the coils, each said at least one pusher pin being movable into a respective guide slot of said receiver for keeping said receiver from rotating with respect to said support member.

2. A cable depositing device, as claimed in claim 1, wherein each of said rotary members comprise an endless conveyor belt having said at least one pusher pin extending therefrom.

3. A cable depositing device, as claimed in claim 1, wherein said receiver comprises a curved surface of revolution about an axis and each of said rotary members comprises an endless conveyor having a reach extending alongside and parallel to a generator of the curved surface of said receiver with said pusher pin carried on said endless conveyor and movable downwardly alongside the surface of the receiver to engage and push successive windings of the cable along the surface of said receiver, said curved surface of said receiver including said guide slots into which said pin extends so as to engage behind each coil of cable.

4. A cable depositing device, as claimed in claim 1, wherein each of said rotary members comprises a disc rotatably mounted to said support member having said at least one pusher pin extending therefrom.

5. A cable depositing device, as claimed in claim 4, wherein each disc has a plurality of evenly circumferentially spaced pusher pins extending therefrom.

6. A cable depositing device, as claimed in claim 1, wherein said receiver includes a frusto conical surface having a larger diameter adjacent said distributor and a smaller diameter at the end thereof adjacent said container.

7. A cable depositing device, as claimed in claim 1, wherein said receiver comprises a body of revolution having a plurality of substantially axially extending guide grooves forming said plurality of guide slots, each guide groove having an outwardly tapered entrance end for receiving said at least one pusher pin.

8. A cable depositing device, as claimed in claim 1, wherein said receiver comprises a plurality of rods spaced around a central, generally vertical axis and having gaps therebetween which extend axially and which form said guide slots.

* * * * *